US010511899B2

(12) United States Patent
Yokosawa et al.

(10) Patent No.: US 10,511,899 B2
(45) Date of Patent: Dec. 17, 2019

(54) ELECTRONIC INSTRUMENT AND ILLUMINATION SYSTEM

(71) Applicant: SONY CORPORATION, Tokyo (JP)

(72) Inventors: Nobuyuki Yokosawa, Saitama (JP); Shinji Hirai, Tokyo (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 16/086,689

(22) PCT Filed: Jan. 30, 2017

(86) PCT No.: PCT/JP2017/003200
§ 371 (c)(1),
(2) Date: Sep. 20, 2018

(87) PCT Pub. No.: WO2017/169065
PCT Pub. Date: Oct. 5, 2017

(65) Prior Publication Data

US 2019/0110115 A1 Apr. 11, 2019

(30) Foreign Application Priority Data

Mar. 28, 2016 (JP) ..... 2016-064247

(51) Int. Cl.

| | |
|---|---|
| ***H04R 1/02*** | (2006.01) |
| ***F21V 33/00*** | (2006.01) |
| ***F21S 8/04*** | (2006.01) |
| ***H04R 1/28*** | (2006.01) |
| *F21Y 105/18* | (2016.01) |
| *F21Y 115/10* | (2016.01) |

(Continued)

(52) U.S. Cl.
CPC ..... *H04R 1/025* (2013.01); *F21S 8/04* (2013.01); *F21V 33/00* (2013.01); *F21V 33/0056* (2013.01); *H04R 1/028* (2013.01); *H04R 1/2826* (2013.01); *F21V 23/003* (2013.01); *F21V 23/02* (2013.01); *F21Y 2105/18* (2016.08); *F21Y 2115/10* (2016.08); *H04R 1/021* (2013.01); *H04R 1/2815* (2013.01); *H04R 2201/021* (2013.01)

(58) Field of Classification Search
CPC ..... H04R 1/028; H04R 1/025; H04R 1/2826; F21V 23/02; F21V 33/0056; F21V 23/023; F21S 8/04; F21Y 2115/10; F21Y 2105/18
See application file for complete search history.

(56) References Cited

U.S. PATENT DOCUMENTS

| | | | |
|---|---|---|---|
| 2008/0308344 | A1 | 12/2008 | Kane et al. |
| 2014/0307471 | A1 | 10/2014 | Yokosawa |
| 2016/0306103 | A1 | 10/2016 | Yokosawa |

FOREIGN PATENT DOCUMENTS

| | | | |
|---|---|---|---|
| CN | 104100860 | A | 10/2014 |
| EP | 2792945 | A1 | 10/2014 |

(Continued)

OTHER PUBLICATIONS

International Search Report and Written Opinion of PCT Application No. PCT/JP2017/003200, dated May 9, 2017, 8 pages of ISRWO.

(Continued)

*Primary Examiner* — Regina N Holder
(74) *Attorney, Agent, or Firm* — Chip Law Group

(57) ABSTRACT

An electronic instrument includes a housing, a fitting part that is freely attached/detached to/from an illumination apparatus, and a sound reproduction space that is formed in the housing.

6 Claims, 13 Drawing Sheets

(51) Int. Cl.
*F21V 23/00* (2015.01)
*F21V 23/02* (2006.01)

(56) References Cited

FOREIGN PATENT DOCUMENTS

| | | | |
|---|---|---|---|
| JP | 2008-243581 | A | 10/2008 |
| JP | 2014-207184 | A | 10/2014 |
| JP | 2014-209411 | A | 11/2014 |
| JP | 2016-019129 | A | 2/2016 |
| JP | 6136502 | B2 | 5/2017 |
| WO | 2008/157040 | A1 | 12/2008 |

OTHER PUBLICATIONS

Extended European Search Report of EP Patent Application No. 17773614.7, dated Jan. 23, 2019, 8 pages.

ELECTRONIC INSTRUMENT AND ILLUMINATION SYSTEM

CROSS REFERENCE TO RELATED APPLICATIONS

This application is a U.S. National Phase of International Patent Application No. PCT/JP2017/003200 filed on Jan. 30, 2017, which claims priority benefit of Japanese Patent Application No. JP 2016-064247 filed in the Japan Patent Office on Mar. 28, 2016. Each of the above-referenced applications is hereby incorporated herein by reference in its entirety.

TECHNICAL FIELD

The present technology relates to an electronic instrument and an illumination system.

BACKGROUND ART

In the past, an illumination system in which a sound reproduction apparatus that is an example of an electronic instrument is attachable/detachable to/from an illumination apparatus has been proposed (see, e.g., PTL 1 to be described).

CITATION LIST

Patent Literature

[PTL 1]
JP 2014-209411A

SUMMARY

Technical Problem

In such a system, it is desired that a configuration of the sound reproduction apparatus is improved and thereby a phenomenon such that vibrations of the sound reproduction apparatus are propagated to the illumination apparatus to sway illumination light or the like is prevented.

Accordingly, it is an object of the present technology to provide a new and useful electronic instrument and illumination system that solve the problem.

Solution to Problem

In order to solve the above-described problem, according to the present technology, for example, an electronic instrument includes a housing, a fitting part that is freely attached/detached to/from an illumination apparatus, and a sound reproduction space that is formed in the housing.

Further, according to the present technology, an illumination system includes an illumination apparatus, and an electronic instrument that is freely attached/detached to/from the illumination apparatus. The electronic instrument includes a housing, a fitting part that is freely attached/detached to/from the illumination apparatus, and a sound reproduction space that is formed in the housing.

Advantageous Effect of Invention

According to at least one embodiment of the present technology, vibrations caused by the electronic instrument can be suppressed. Note that the effect described here is not necessarily limited thereto, but any of the effects described in the present technology are applicable. Further, contents of the present technology are not limited and interpreted on the basis of the illustrated effects.

DESCRIPTION OF EMBODIMENTS

Hereinafter, embodiments of the present technology and the like will be described with reference to the drawings. Note that description will be made in the following order.

<1. Embodiment>

<2. Modified Example>

The embodiments and the like described below are preferable specific examples of the present technology, and contents of the present technology are not limited to these embodiments and the like. Note that the figures used in the following description are enlarged or reduced appropriately in consideration of the convenience of description, and sizes and the like of the respective figures are not necessarily matched with each other in some cases. In addition, in order to prevent complication of illustration, a reference symbol is assigned to only a portion of components in some cases.

"An Appearance Example of an Illumination System"

Figure 1:
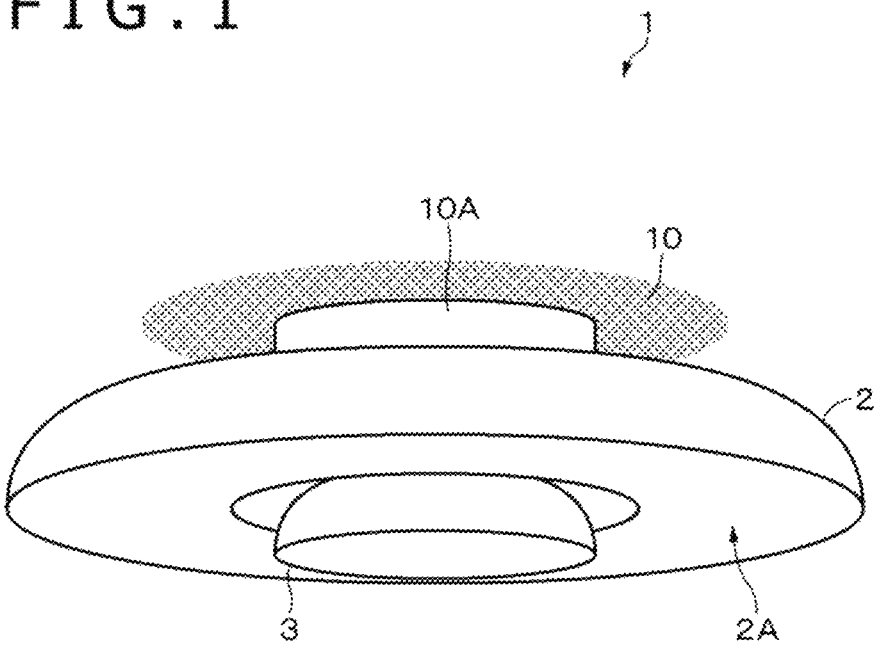
FIG. 1 is a diagram describing an appearance example of an illumination system according to an embodiment of the present technology.
Figure 2:
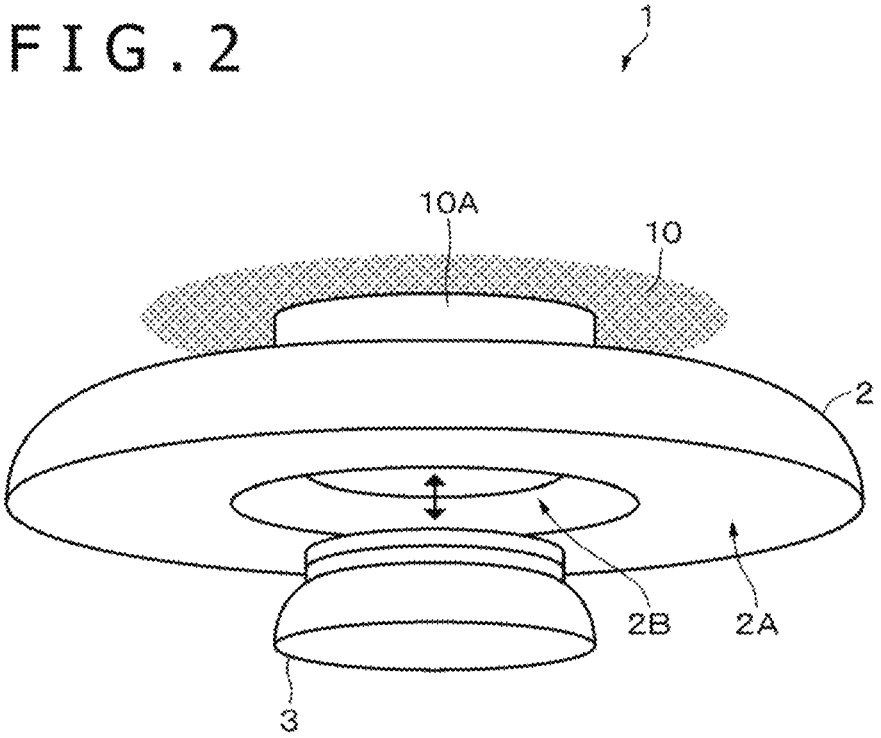
FIG. 2 is a diagram describing an appearance example of the illumination system according to the embodiment of the present technology.

FIGS. 1 and 2 are diagrams describing an appearance example of an illumination system (illumination system 1) according to an embodiment. The illumination system 1 includes an illumination apparatus 2 and a portable electronic instrument 3. In the present embodiment, as illustrated in FIG. 2, the illumination system 1 is configured so that the electronic instrument 3 is freely attached/detached to/from the illumination apparatus 2.

The illumination apparatus 2 is, for example, an illumination apparatus for a room and is fitted to a ceiling rosette 10A formed on a ceiling surface 10 in the room. The illumination apparatus 2 has a light emission surface 2A that emits light for illuminating the room and an attaching section 2B that attaches the electronic instrument 3 so as to be attachable/detachable. In the present example, an area in which light is emitted in the light emission surface 2A is formed, for example, in a predetermined shape such as an annular shape (donut shape).

The attaching section 2B of the illumination apparatus 2 is formed inside (i.e., a nearly central part of the light emission surface 2A) the annular-shaped light emission area in the light emission surface 2A. Further, the attaching section 2B is configured so that the electronic instrument 3 is held on the lower side (floor surface side in the room) than the light emission surface 2A. Note that a position in which the attaching section 2B is formed just has to be determined so that a harmful influence is not exerted on a light distribution pattern in the room by the attached electronic instrument 3 and ought not to be limited to the above-described position.

The illumination apparatus 2 is attached to the ceiling rosette 10A to thereby input a commercial AC power source. Switching for inputting the commercial AC power source into the illumination apparatus 2 is performed by a wall switch etc. formed on a wall surface in the room.

The electronic instrument 3 is formed, for example, in a nearly cylindrical shape as a whole and is formed in a shape that becomes slightly wide toward one end side (floor side). Details are described below; further, the electronic instrument 3 in the present example has a sound reproduction function and an imaging function. In the electronic instrument 3, more specifically, a sound reproduction surface (e.g., a fitting surface of a speaker unit SP to be described) is held on the lower side than the light emission surface 2A. Through this process, a sound reproduced from the electronic instrument 3 is not intercepted by the illumination apparatus 2 but can be reproduced to a user who positions on the floor side. Further, the electronic instrument 3 is held on the lower side than the light emission surface 2A, and thereby an internal portion of the room can be imaged (photographed) by the electronic instrument 3 without being intercepted by the illumination apparatus 2.

Note that as a specific mechanism for attaching the electronic instrument 3 so as to be attachable/detachable to/from the illumination apparatus 2, for example, an engaging mechanism or screwing mechanism using a nail part, an attachment/detachment mechanism using a magnetic force, and the like can be included. A configuration for attaching the electronic instrument 3 so as to be attachable/detachable to/from the illumination apparatus 2 is not limited to the illustrated configuration; further, various configurations can be adopted.

In the following description, unless otherwise noted, directions such as upper and lower (or bottom) right and left, horizontal, vertical, etc. are regulated and descriptions will be made with reference to the attaching direction of the electronic instrument 3.

"An Internal Configuration Example of the Illumination Apparatus and the Electronic Instrument"

Figure 3:
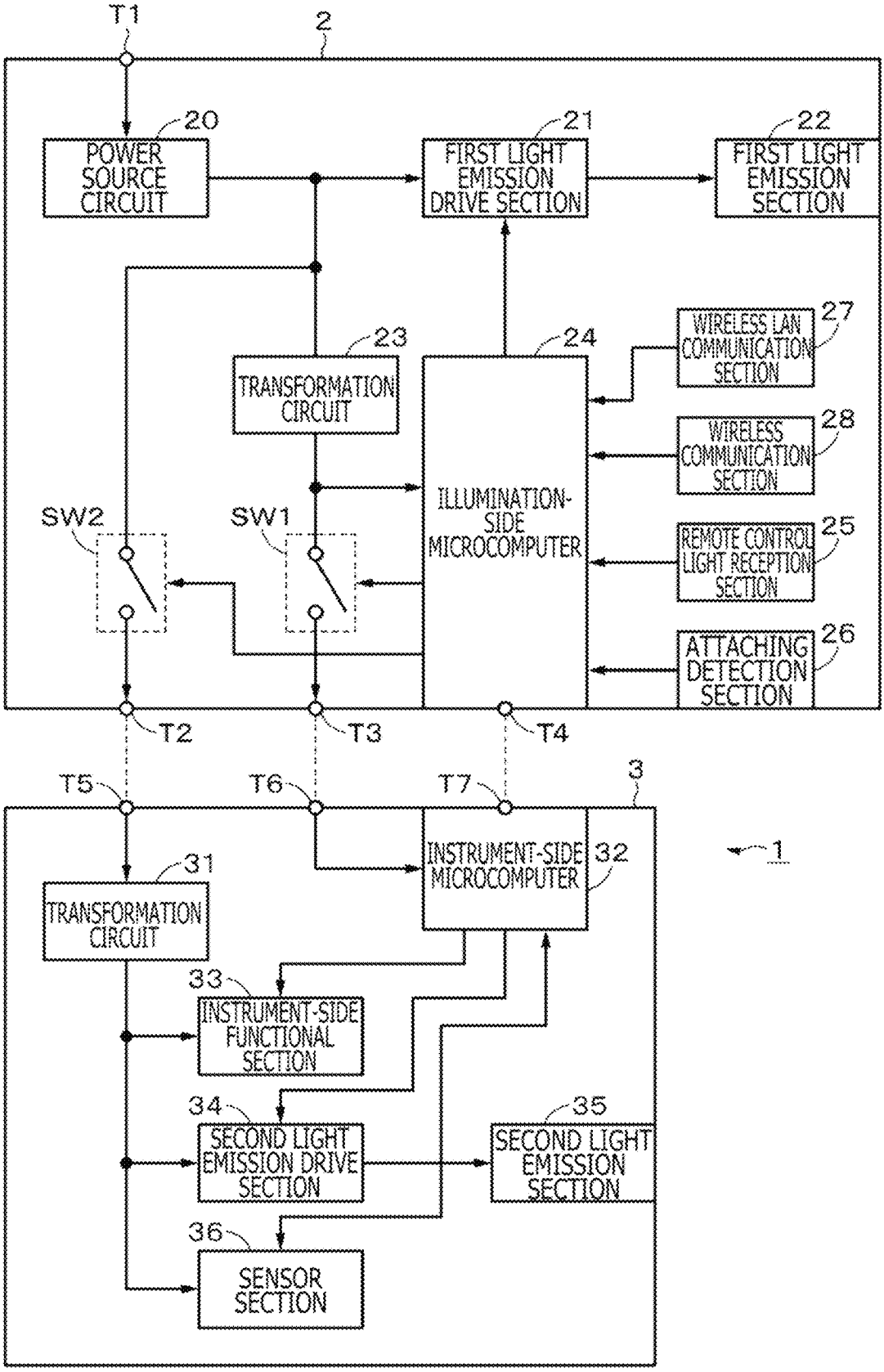
FIG. 3 is a diagram describing an internal configuration example of the illumination system according to the embodiment of the present technology.

FIG. 3 is a diagram illustrating an internal configuration example of the illumination apparatus 2 and the electronic instrument 3 constituting the illumination system 1. The illumination apparatus 2 has a power source circuit 20, a first light emission drive section 21, a first light emission section 22, a transformation circuit 23, an illumination-side microcomputer (hereinafter, arbitrarily abbreviated as a microcomputer) 24, a remote control light reception section 25, an attaching detection section 26, a wireless LAN (Local Area Network) communication section 27, a wireless communication section 28, a switch SW1, a switch SW2, a power source input terminal T1, a power output terminal T2, a power output terminal T3, and a data communication terminal T4.

The commercial AC power source is input to the power source circuit 20 via the power source input terminal T1. The power source circuit 20 includes an AC-DC converter and generates a predetermined level of DC voltage on the basis of the input commercial AC power source. The DC voltage generated by the power source circuit 20 is supplied to the first light emission drive section 21, the transformation circuit 23, and the switch SW2.

The switch SW2 switches on/off of a power supply from the power source circuit 20 to the power output terminal T2 in accordance with an instruction from an illumination-side microcomputer 24. Note that the switch SW2 is off in an initial condition.

The first light emission drive section 21 inputs the DC voltage supplied from the power source circuit 20 as an operation voltage. Then, on the basis of the instruction from the illumination-side microcomputer 24, the first light emission drive section 21 generates a driving signal for driving a light emission of a light-emitting device constituting the first light emission section 22. In the case of the present example, an LED (Light Emitting Diode) is used as the light-emitting device constituting the first light emission section 22. In accordance with the configuration, a constant current circuit for generating a predetermined level of constant current is formed in the first light emission drive section 21 on the basis of the DC voltage and the driving signal is generated on the basis of the output current through the constant current circuit.

The first light emission section 22 forms a configuration having a plurality of LEDs and the plurality of LEDs are, for example, arranged circularly. The first light emission drive section 21 selects an LED that provides a driving signal to thereby adjust (dimming control) a light emitting amount and light emitting color of the first light emission section 22. In accordance with a light emission from the first light emission section 22, light is emitted from the light emission surface 2A illustrated in FIGS. 1 and 2. That is, the first light emission section 22 is a light emission section used for illumination.

The transformation circuit 23 transforms the DC voltage supplied from the power source circuit 20 into a predetermined level. The transformed DC voltage is supplied to the illumination-side microcomputer 24 and is simultaneously supplied to the switch SW1.

The switch SW1 switches on/off of the power supply from the transformation circuit 23 to the power output terminal T3 in accordance with the instruction from the illumination-side microcomputer 24. Note that even the switch SW1 is off in an initial condition similarly to the previous switch SW2.

The illumination-side microcomputer 24 includes, for example, a CPU (Central Processing Unit), a ROM (Read Only Memory), and a RAM (Random Access Memory) functioning as a work area and performs the entire control of the illumination apparatus 2. To the illumination-side microcomputer 24, the remote control light reception section (hereinafter, arbitrarily abbreviated as a remote control light reception section) 25 is connected. The remote control light reception section 25 is set to an infrared light receiving section and receives an infrared signal emitted from a remote control (not illustrated) to acquire an input signal for a remote operation. The illumination-side microcomputer 24 instructs the first light emission drive section 21 to perform the above-described dimming control on the basis of an operation input signal acquired by the remote control light reception section 25. Further, in accordance with the operation input signal for instructing switch-off, the illumination-side microcomputer 24 instructs the first light emission drive section 21 to allow all LEDs of the first light emission section 22 to switch off a light.

In addition, to the illumination-side microcomputer 24, the attaching detection section 26 is connected. The attaching detection section 26 detects an attachment state of the electronic instrument 3 to the illumination apparatus 2. The attaching detection section 26 in the present example includes a mechanical section that operates in accordance with the attachment/detachment state of the electronic instrument 3 to/from the illumination apparatus 2 and a switch that is switched-on/off in accordance with an operation of the mechanical section. Specifically, for example, the attaching detection section 26 includes the mechanical section that is pushed and pulled in accordance with the attachment/detachment state of the electronic instrument 3 and the switch that is switched-on/off cooperatively by pushing and pulling the mechanical section. A detection signal that is generated so as to indicate the attachment/detachment state of the electronic instrument 3 by the above-described attaching detection section 26 is provided for the illumination-side microcomputer 24.

Further, to the illumination-side microcomputer 24, the data communication terminal T4 for performing data communication with an instrument-side microcomputer 32 to be described is connected.

A wireless LAN communication section 27 performs wireless data communication, for example, in accordance with IEEE 802.11 standards. Further, the wireless LAN communication section 27 establishes a connection with an external wireless LAN router to thereby be connected to the Internet.

The wireless communication section 28 performs wireless data communication in accordance with wireless communication standards other than wireless LAN. Further, in the present example, the wireless communication section 28 performs wireless data communication in accordance with Bluetooth (registered trademark) standard.

Continuously, an internal configuration example of the electronic instrument 3 will be described.

The electronic instrument 3 has, for example, a transformation circuit 31, the instrument-side microcomputer 32, an instrument-side functional section 33, a second light emission drive section 34, a second light emission section 35, a sensor section 36, a power supply terminal T5, a power supply terminal T6, and a data communication terminal T7.

The transformation circuit 31 transforms a DC voltage supplied from the illumination apparatus 2 via the power supply terminal T5 into a predetermined level and outputs the DC voltage to the instrument-side functional section 33, the second light emission drive section 34, and the sensor section 36. Note that the transformation circuit 31 is configured so that the DC voltage input from the power supply terminal T5 is transformed into a request voltage level of the instrument-side functional section 33 or the like to be output.

The instrument-side microcomputer 32 includes a CPU, a ROM, and a RAM and controls the instrument-side functional section 33. The instrument-side microcomputer 32 operates by using the DC voltage input from the power supply terminal T6. To the instrument-side microcomputer 32, the data communication terminal T7 for performing data communication with the illumination-side microcomputer 24 is connected. Further, authentication information used in authentication processing is stored in a ROM included in the instrument-side microcomputer 32. In the case of the present example, information regarding an authentication key is at least stored as the authentication information.

The instrument-side functional section 33 inclusively indicates a configuration of each section to be controlled by the instrument-side microcomputer 32. In the instrument-side functional section 33, a main configuration for implementing a function as the electronic instrument 3 is included. In the present example, since the electronic instrument 3 has the sound reproduction function and the imaging function, a configuration for implementing the sound reproduction function of a speaker, an amplifier, a sound signal processing section, or the like and a configuration for implementing a function of obtaining picked-up image data of an imaging optical system, an image processing section, or the like are formed on the instrument-side functional section 33. A known configuration can be arbitrarily combined and applied to the above-described configurations.

The second light emission drive section 34 inputs the DC voltage supplied from the transformation circuit 31 as an operation voltage. On the basis of an instruction from the instrument-side microcomputer 32, the second light emission drive section 34 generates a driving signal for driving a light emission of the light-emitting device constituting the second light emission section 35. In the case of the present example, an LED is used as the light-emitting device constituting the second light emission section 35. In accordance with the configuration, a constant current circuit for generating a predetermined level of a constant current is formed on the second light emission drive section 34 on the basis of the DC voltage and the driving signal is generated on the basis of the output current through the constant current circuit.

As described above, the second light emission section 35 includes LEDs. Specifically, the second light emission section 35 includes eight pieces of LEDs having a peak emission wavelength in a range (in view of the wavelength, 850 to 950 nm (nanometers)) of infrared radiation. Details are described below and the second light emission section 35 is arranged in a circular shape with a nearly equal interval (interval of nearly 45 degrees) along an outer circumference of a housing of the electronic instrument 3. The second light emission section 35 emits light, and thereby infrared communication is performed with an electric instrument (e.g., a television apparatus or an air-conditioning equipment) that is arranged in the room and the electric instrument is controlled.

The sensor section 36 includes various types of sensors. The sensor section 36 in the present example is generically named as, for example, a temperature/humidity sensor, an illuminance sensor, and a human sensor.

Note that an illustration is omitted; further, in the present example, a portable memory such as an SD memory card or a USB (Universal Serial Bus) is freely attached/detached to/from the electronic instrument 3.

Here, in the power output terminal T2, the power output terminal T3, and the data communication terminal T4 that are formed on the side of the illumination apparatus 2 and further the power supply terminal T5, the power supply terminal T6, and the data communication terminal T7 that are formed on the side of the electronic instrument 3, "the power output terminal T2 and the power supply terminal T5," "the power output terminal T3 and the power supply terminal T6," and "the data communication terminal T4 and the data communication terminal T7" respectively are connected in response to an attachment of the electronic instrument 3 to the illumination apparatus 2. That is, in response to the attachment of the electronic instrument 3 to the illumination apparatus 2, it is possible to perform the power supply (supply of the operation voltage) from the illumination apparatus 2 side to the electronic instrument 3 side. At the same time, it is possible to perform data communication between the illumination-side microcomputer 24 and the instrument-side microcomputer 32.

"An Example of Processing that is Performed in the Illumination System 1"

An example of processing that is performed in the illumination system 1 will be schematically described. Of course, the processing that is described hereinafter is one example and processing other than the processing that is described hereinafter may be performed. Note that the processing that is described hereinafter is, for example, controlled by using the illumination-side microcomputer 24 and the instrument-side microcomputer 32.

Between the illumination apparatus 2 and the electronic instrument 3, for example, the authentication processing is performed. Specifically, when the electronic instrument 3 is attached to the illumination apparatus 2, the authentication key is transmitted from the electronic instrument 3 to the illumination apparatus 2. The illumination apparatus 2 determines whether or not the authentication key is a predetermined key and whether or not the electronic instrument 3 is a regular instrument. In the case where it is authenticated that the electronic instrument 3 is the regular instrument, it is possible to perform the sound reproduction function etc. by the electronic instrument 3.

The sound reproduction function is performed by using the electronic instrument 3. Reproduction of music is instructed by using an information processing apparatus (an illustration is omitted) implemented by various types of computer apparatuses such as a smartphone, a tablet terminal, or a PC (personal computer). A signal indicating the instruction is received by using the wireless communication section 28. The illumination-side microcomputer 24 instructs the instrument-side microcomputer 32 to reproduce the instructed music. The instrument-side microcomputer 32 reproduces the music in accordance with the instruction. Note that, music data to be reproduced may be data transmitted by the information processing apparatus, data stored in the illumination apparatus 2 (may be stored even in the electronic instrument 3), or data acquired via a portable memory or a network.

A control function is performed to an electric instrument by using the electronic instrument 3. Examples of the electric instrument include a television apparatus or air-conditioning equipment in the same room as that of the illumination system 1. Information (a maker, a model number, etc.) regarding the electric instrument to be controlled is registered in the above-described information processing apparatus. The wireless communication section 28 receives, for example, a control command for switching on/off of the registered air-conditioning equipment from the information processing apparatus. The illumination-side microcomputer 24 provides the control command from the information processing apparatus for the instrument-side microcomputer 32 via the data communication terminal T4.

The instrument-side microcomputer 32 drives the second light emission drive section 34 and performs modulation processing so that the control command becomes a control command suitable for the air-conditioning equipment to be controlled. Then, the second light emission drive section 34 is driven to thereby allow the second light emission section 35 to emit light and a control command through infrared optical communication is issued as an optical signal (infrared light). The control command is received by the air-conditioning equipment to be controlled and the air-conditioning equipment is switched-on/off. Note that the control command from the information processing apparatus may be provided for the illumination apparatus 2 via the Internet and this process permits various types of instruments to be controlled from the outside of the room (out of doors).

"A Configuration Example of the Electronic Instrument"

Meanwhile, as in the illumination system 1, in the case where the electronic instrument 3 having the sound reproduction function and the imaging function is attached to the illumination apparatus 2, the following points needs to be noticed. Firstly, when the electronic instrument 3 reproduces a sound, vibrations of a speaker are desired to be prevented from being propagated to a ceiling surface. The reason is that in the case of complex housing or the like, there is the possibility that uncomfortable feeling is provided for residents that live in an upper floor owing to vibrations propagated to the ceiling surface, or the like. Secondly, vibrations of the speaker are desired to be prevented from being propagated to the illumination apparatus 2. The reason is that the vibrations of the speaker are propagated to the illumination apparatus 2 and this process permits light of illumination to be swayed and a flicker to occur, or the like. Thirdly, in the case in which the electronic instrument 3 has the imaging function, there is the possibility that an image of a camera is blurred owing to vibrations of the speaker. To solve the above problems, the number of the speakers is increased or the entire unit is enlarged without increasing costs, and a configuration of the electronic instrument 3 according to the above points is desired. Hereinafter, the electronic instrument 3 according to the embodiment of the present technology performed in view of the above points will be described in detail.

Figure 4:
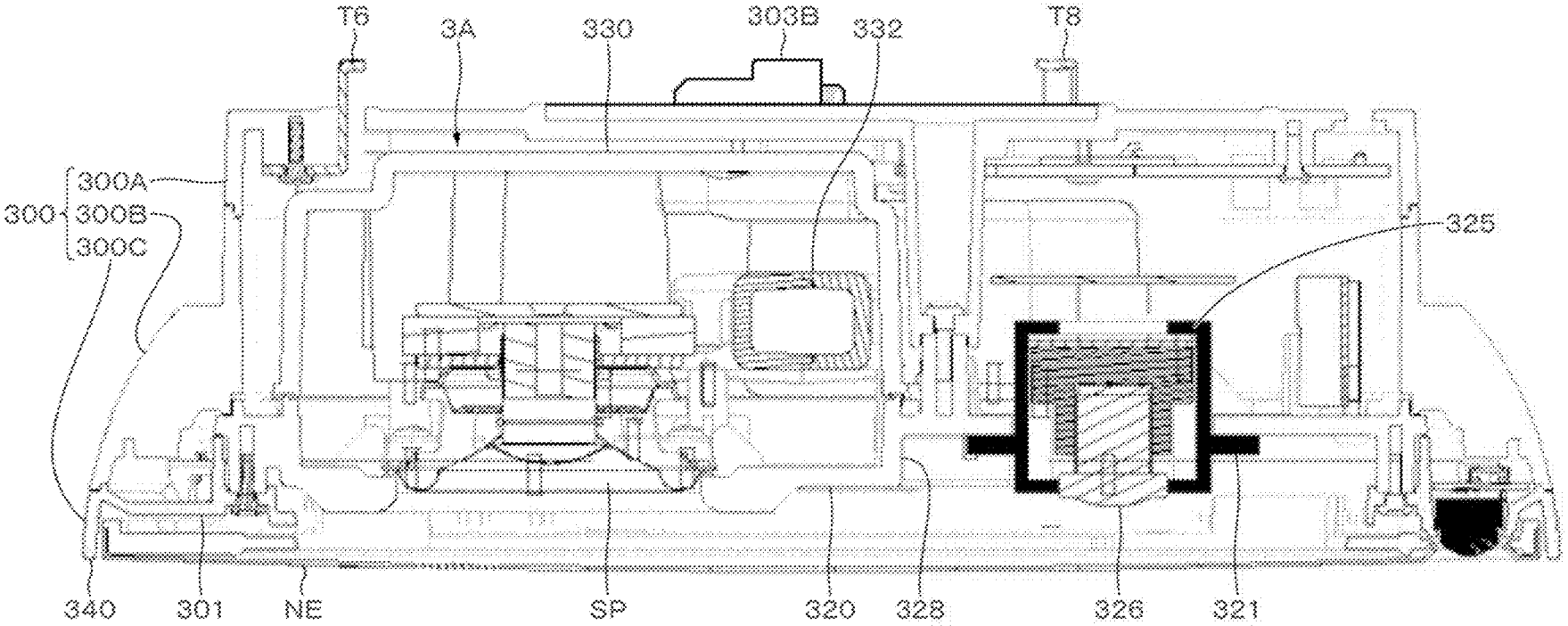
FIG. 4 is a diagram describing a configuration example of an electronic instrument according to the embodiment of the present technology.
Figure 5A:
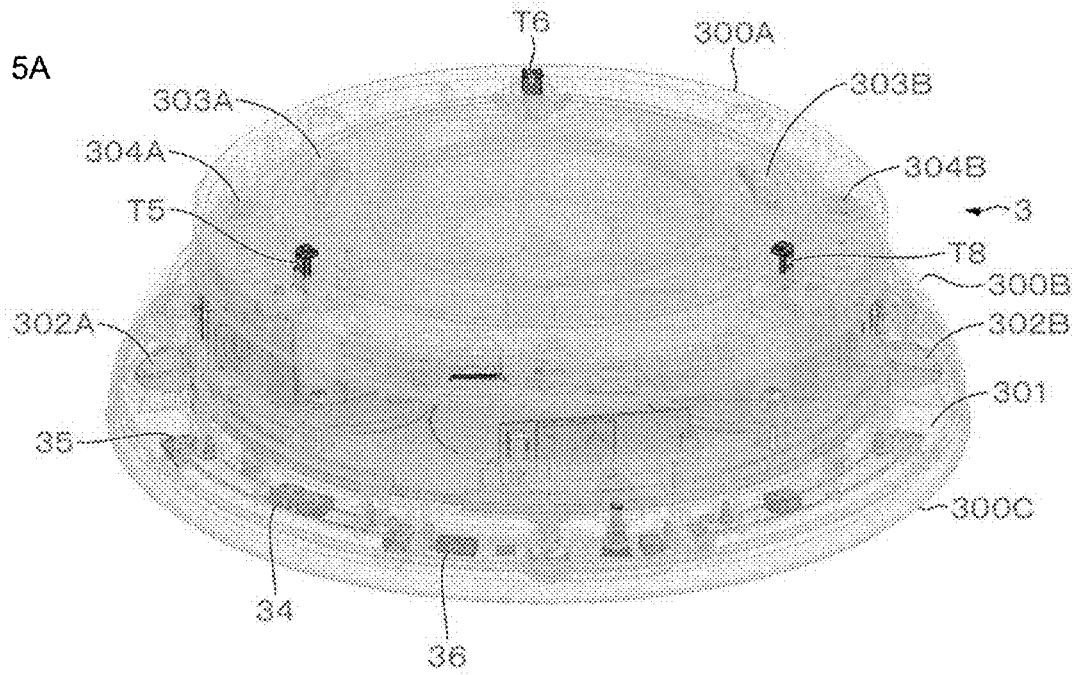
FIGS. 5A and 5B are diagrams describing a configuration example of the electronic instrument according to the embodiment of the present technology.
Figure 5B:
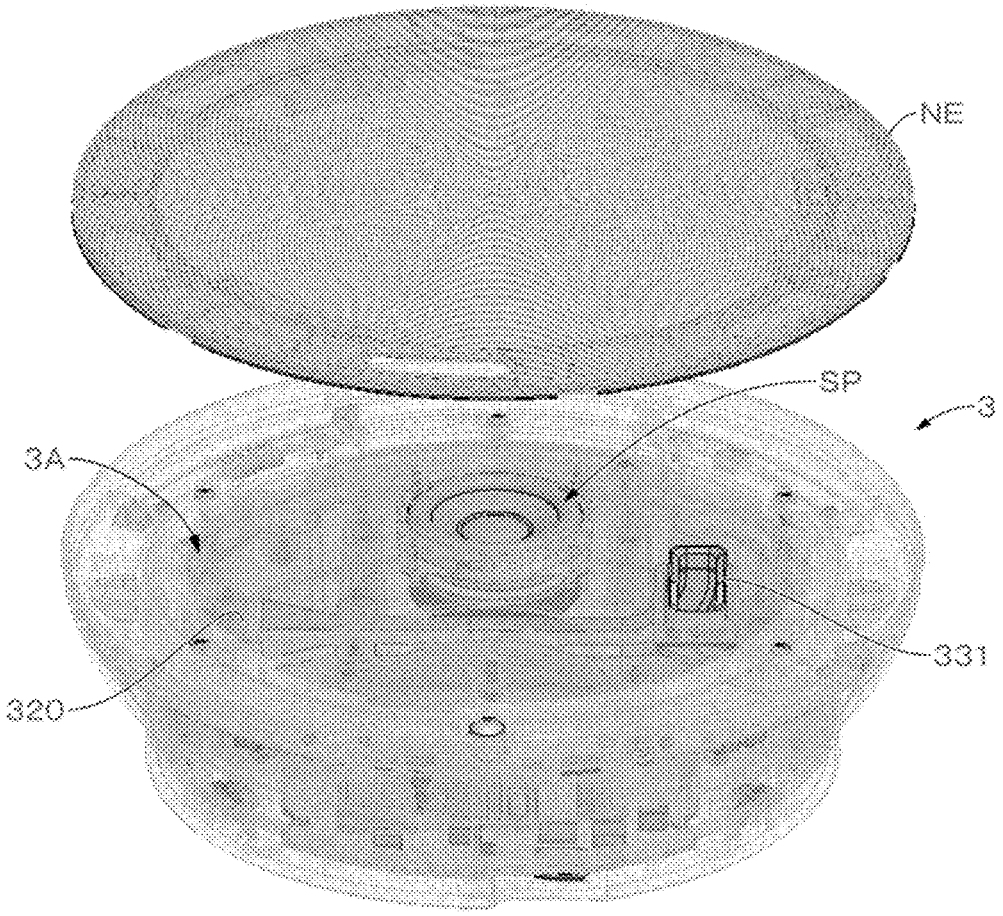

A physical configuration example of the electronic instrument 3 will be described with reference to FIGS. 4, 5A and 5B. FIG. 4 is a cross-sectional diagram illustrating the electronic instrument 3 according to the embodiment. FIG. 5A is an oblique perspective diagram describing a configuration example of the electronic instrument 3 according to the embodiment and FIG. 5B is an oblique diagram (partially, an exploded oblique diagram) describing a configuration example of the electronic instrument 3 according to the embodiment. Note that FIGS. 5A and 5B illustrate by inverting the electronic instrument 3 vertically.

The electronic instrument 3 is formed in a nearly cylindrical shape as a whole and has a housing 300 that becomes slightly wide toward one end side (floor side). The housing 300 has an upper housing part 300A that has a nearly ring-like shape and one end of which is sealed on the top face, a base housing part 300B that has a nearly ring-like shape and becomes slightly wide toward a floor side, and a lower housing part 300C that has a nearly ring-like shape. The upper housing part 300A, the base housing part 300B, and the lower housing part 300C are engaged with each other, and are fixed by screws or the like to thereby be integrated to constitute the housing 300.

The upper housing part 300A and the base housing part 300B are made of resin or the like. Further, the lower housing part 300C includes a member that transmits infrared light and an outer edge thereof functions as a light guide component 340 to be described. The light guide component 340 is a member that is arranged in an emission direction of infrared light emitted from the second light emission section 35 and diffuses a portion of infrared light in a predetermined direction. A functional unit 3A to be described is housed in an internal space formed in the housing 300.

There is formed a flat part 301 that directs from the light guide component 340 of the lower housing part 300C to an internal portion of the housing 300. In the flat part 301, for example, the second light emission drive section 34, the second light emission section 35, and the sensor section 36 are arranged (note that a reference signal is assigned to only a portion of the above parts in the figures).

Release levers 302A and 302B are arranged on an outer surface of the housing 300. When the electronic instrument 3 is detached from the illumination apparatus 2, while the user pushes two pieces of the release levers 302A and 302B, an operation for detaching the electronic instrument 3 is performed. Specifically, when the electronic instrument 3 is not grasped with both hands, the illumination system 1 has a configuration in which the electronic instrument 3 cannot be detached from the illumination apparatus 2. This process permits the electronic instrument 3 to be prevented from dropping at the time of attaching/detaching the electronic instrument 3 to/from the illumination apparatus 2.

From an upper surface of the upper housing part 300A, a plurality of terminals (an example of a fitting part) for traction are exposed. The illumination system 1 has a configuration in which the terminals are fixed on the upper housing part 300A with screws etc. and the terminals are fitted to the attaching section 2B of the illumination apparatus 2 to thereby support the electronic instrument 3 to the illumination apparatus 2. From the upper surface of the upper housing part 300A, for example, three pieces of L-shaped metal terminals are exposed on the circumference. Among the above, two terminals are the power supply terminal T5 and the power supply terminal T6 and the one remaining terminal is the terminal T8 for traction. Note that an illustration of the data communication terminal T7 is omitted.

Further, on the upper housing part 300A, there are formed insertion mistake preventing guides 303A and 303B for preventing the electronic instrument 3 from being attached to the attaching section 2B in a mistake direction etc. and lock pins 304A and 304B for preventing the electronic instrument 3 from dropping from the illumination apparatus 2. Note that arrangement locations of the guides and pins and the number of the guides and pins are arbitrarily changeable.

As illustrated in FIG. 4B, a nearly circular speaker net (net grill) NE is fitted to the lower housing part 300C along the vicinity of the outer edge.

"A Configuration Example of the Functional Unit"

Figure 6A:
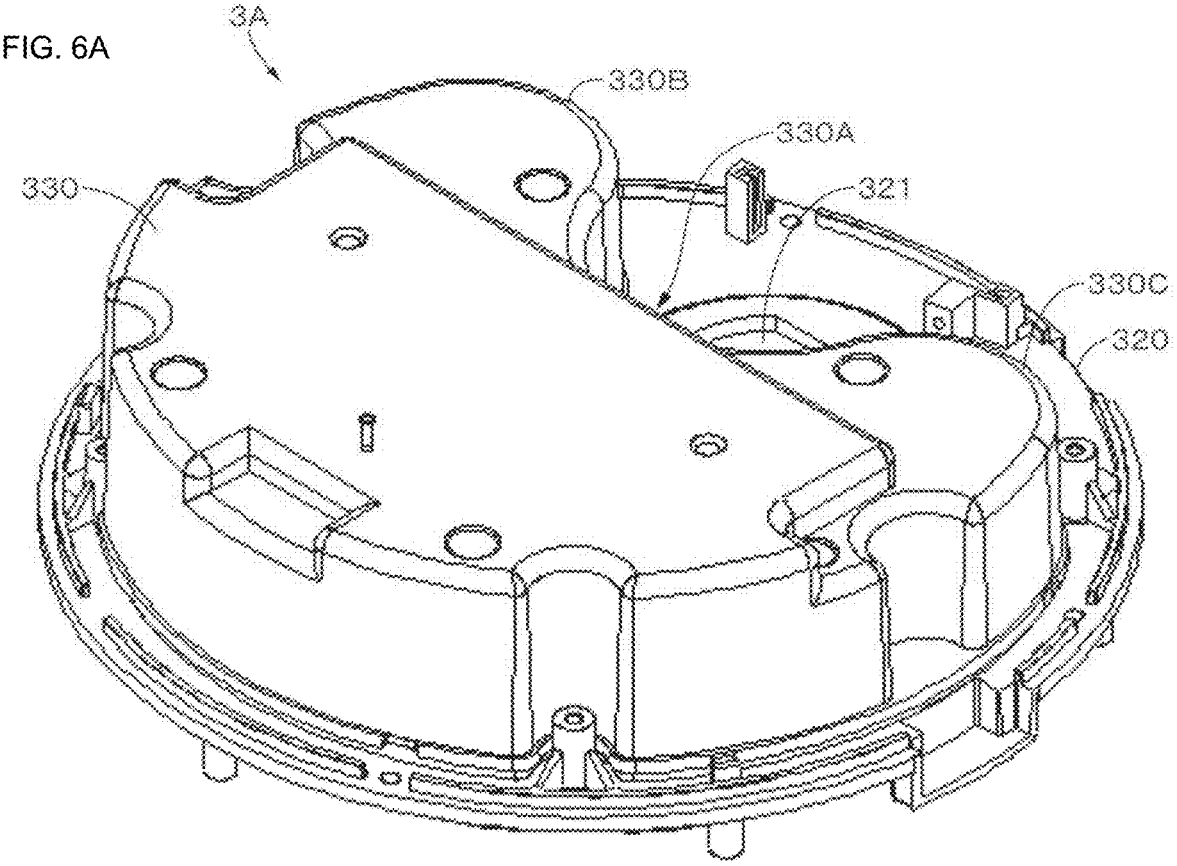
FIGS. 6A and 6B are diagrams describing a configuration example of the electronic instrument according to the embodiment of the present technology.
Figure 6B:
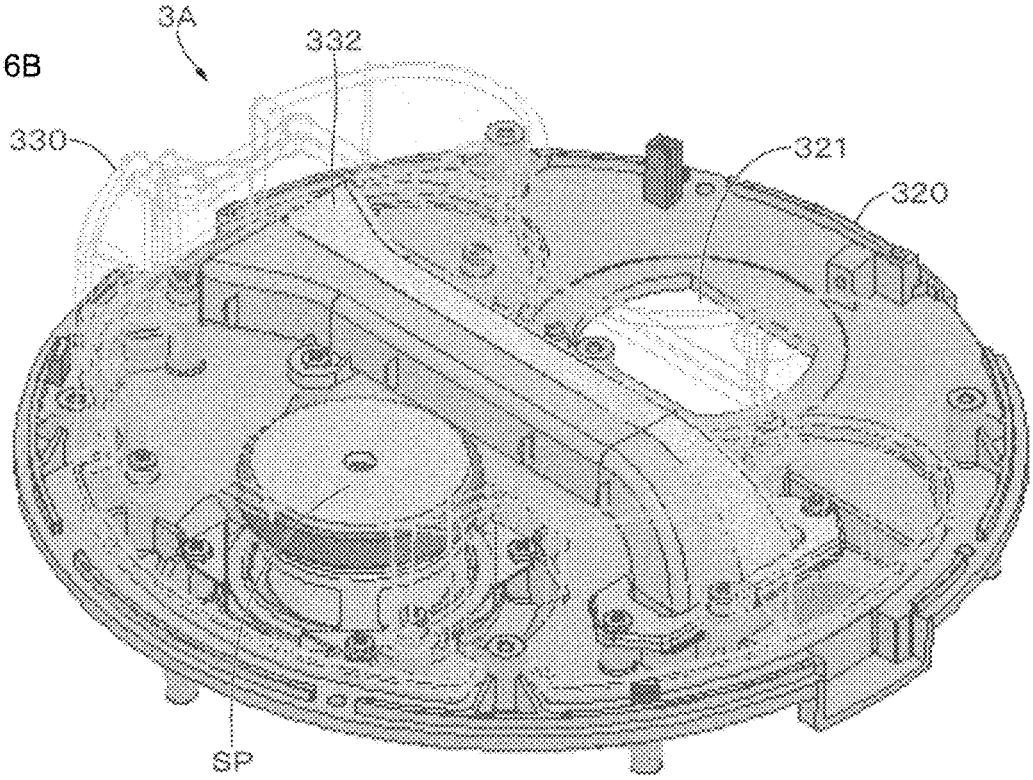
Figure 7:
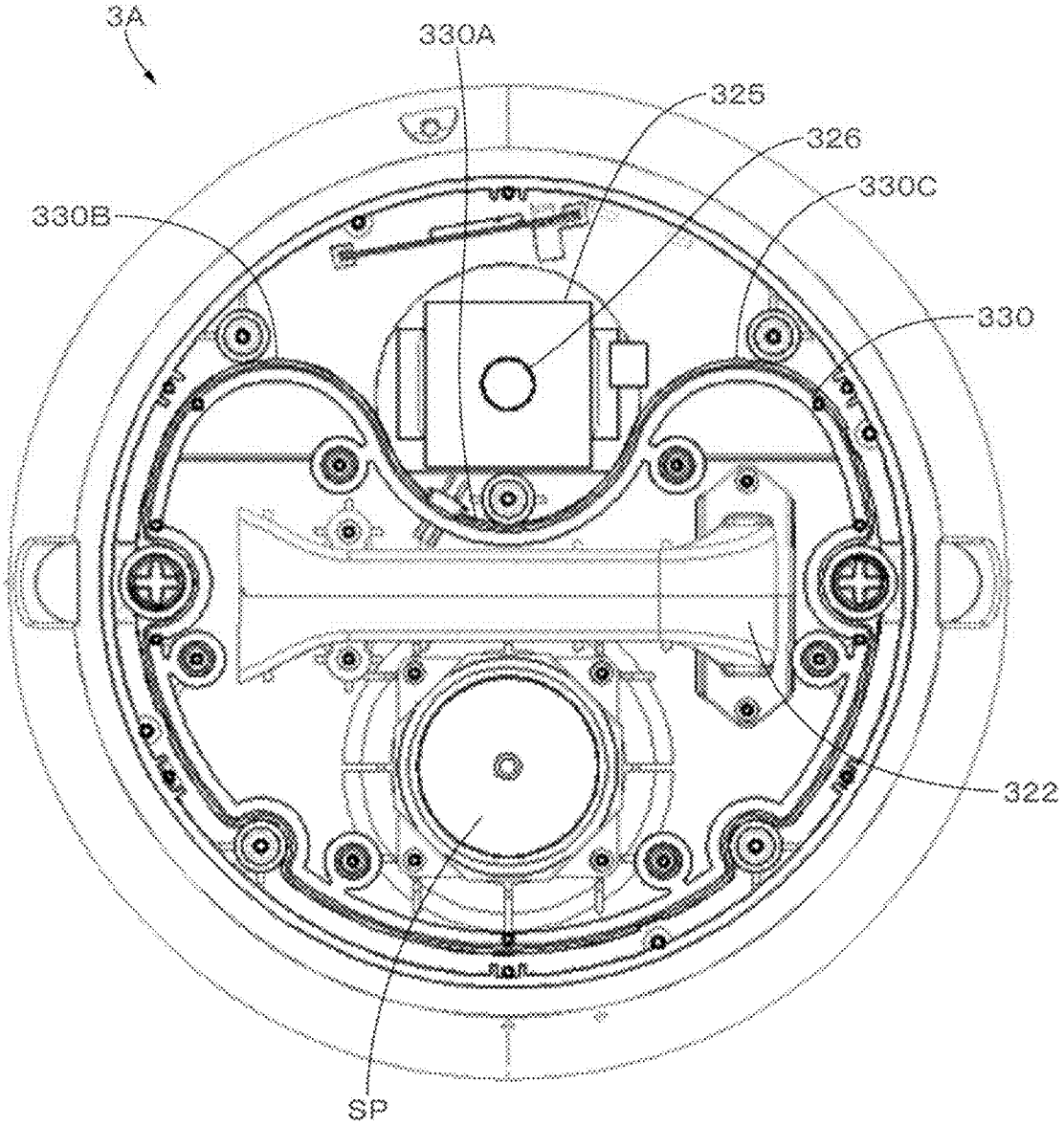
FIG. 7 is a diagram describing a configuration example of the electronic instrument according to the embodiment of the present technology.

Next, in addition to FIGS. 4, 5A, and 5B, a configuration example of the functional unit 3A will be described with reference to even FIGS. 6A, 6B, and 7. Note that FIG. 6A is an oblique diagram illustrating an appearance example of the functional unit 3A, FIG. 6B is a partial perspective diagram of the functional unit 3A, and FIG. 7 is a top diagram describing a configuration example of the functional unit 3A.

The functional unit 3A includes a nearly circular substrate 320. Further, the functional unit 3A is housed and supported in the housing 300 so that the substrate 320 is positioned on the downside. Note that detailed descriptions and illustration are arbitrarily omitted; further, each component of the electronic instrument 3 illustrated in FIG. 3 is connected to the substrate 320 with an arbitrary circuit configuration.

A through-hole for fitting the speaker unit SP and a through-hole 321 (see FIGS. 6A and 6B) functioning as a camera fitting part for fitting an image pickup apparatus (arbitrarily, referred to as a camera) are formed in the substrate 320. In each figure, a state in which the speaker unit SP is fitted is illustrated. In the through-hole 321, a body tube 325 of the camera is fitted so as to block up the through-hole 321. An image pickup part 326 of the camera is exposed downward from the substrate 320. This process permits the user to photograph the room by using the camera.

The speaker unit SP is offset from the center of the substrate 320 and arranged. Further, a bass reflex duct 332 is disposed so as to cross each other approximately in between the center of the substrate 320 and the speaker unit SP. Note that air leakage measures are performed with a gasket etc. in a jointing position between a speaker box 330 and the substrate 320.

The speaker unit SP is, for example, a full-range speaker. The speaker box 330 functioning as an enclosure (sound reproduction space) is formed on an upper surface of the substrate 320. In the present example, a bass reflex system is used in order to compensate for a low-pass characteristic as an enclosure system and a port 331 is formed at a bottom face side of the functional unit 3A. The bass reflex duct 332 is connected to the port 331.

Port shapes of both ends of the bass reflex duct 332 are formed in a flare shape in which a cross-sectional area is, for example, gradually increased toward an outlet port at least on the outlet port side (port 311 side). Even a shape of an inlet port side of the bass reflex duct 332 may be formed in the flare shape. Sound vibrations in a phase opposite to that of a speaker unit diaphragm are released to air from the bass reflex duct 332. Further, a pulsation amplitude of air near to an outlet port of the port 331 corresponds to a sound pressure level of the speaker. The air pulsations exert a vibrational influence even on the speaker net NE formed on the outlet port side of the speaker unit SP. The port shape is formed in the flare shape to thereby obtain an effect of decreasing an intake air pulsation from the port 331.

Continuously, a shape example of the speaker box 330 will be described. When a frequency of a standing wave generated in the speaker box 330 and that of a reproduced sound are matched with each other, an influence is exerted on reproducing characteristics of the speaker unit SP. In the present example, a cross-sectional shape in the horizontal direction of the speaker box 330 is used as a shape capable of suppressing and preventing a standing wave from being generated. The shape capable of suppressing and preventing the standing wave from being generated includes a shape having no faces parallel to each other. In the present example, while a nearly circular shape of the cross-sectional shape in the horizontal direction of the speaker box 330 is used as a base, there is used a deformed circular shape having a deformity 330A in which a portion of the circle is deformed toward the inside and curved protrusions 330B and 330C that are formed by the deformation. The shape permits the standing wave to be suppressed and prevented from being generated. Note that as general measures against the standing wave, an acoustic material that is effective in a particular frequency band is put into the speaker box 330 in many cases; however, in the present example, the acoustic material may be made unnecessary.

Further, the cross-sectional shape of the speaker box 330 is set to a deformed circular shape, and thereby a space for forming the through-hole 321 can be obtained in a position separated from the speaker box 330 in the substrate 320, in other words, an adjacent position in which a slight interval is provided toward the speaker box 330. The electronic instrument 3 is supposed to be carried and fitted to a ceiling as a usage pattern. Therefore, it is not preferable that the electronic instrument 3 grows in size and limitations necessarily occur even to a size of the substrate 320. In view of the above points, when the cross-sectional shape of the speaker box 330 is set to the deformed circular shape, it is possible to form the through-hole 321 and it is possible to effectively use a space of the substrate 320.

Vibrations of the speaker unit SP are transmitted to the periphery, with air pulsations caused by the diaphragm of the speaker unit SP and the bass reflex duct 332 becoming a vibration source. In the present example, the speaker box 330 is arranged in the housing 300 of the electronic instrument 3 to form a double structure. Through this process, vibrations can be suppressed from being propagated to the outside, specifically, to the outside of the housing 300 and vibrations can be prevented from being propagated to the ceiling. It is conceivable that the housing 300 itself of the electronic instrument 3 is also used as the speaker box. However, there is the possibility that in this configuration, the housing 300 needs to be definitely encapsulated and costs are increased due to the configuration. Further, rigidity of the housing 300 needs to be improved in order to suppress vibrations and weight is increased along with the above. Accordingly, the instrument is not adequate for an instrument capable of being carried and fitted to the ceiling side. However, the problems are not caused by the above-described configuration of the electronic instrument 3.

Further, the port shape of the bass reflex duct 332 is set to the flare shape to thereby reduce air pulsations in a low-pass component and make a contribution to reduction in vibrations. This process permits vibrations to be effectively suppressed from being propagated to the ceiling etc.

Note that it is generally known that when a stationary speaker box is put on a floor, three points are supported between a bottom face of the speaker box and the floor to thereby exert a vibration blocking effect on the floor. In accordance with the points, even in the present example, the electronic instrument 3 having the speaker unit SP is supported with three points. Therefore, an effect of further blocking the propagation of vibrations to the ceiling is obtained.

Through the above-described effect of decreasing vibrations along with a speaker reproduction, it is possible to prevent the propagation of vibrations to a camera body. Further, since an air layer is present between the speaker box 330 and the camera, it is possible to more effectively prevent the propagation of vibrations. Accordingly, an integral constitution of the speaker unit SP and the camera can be realized while blurring is prevented from occurring on a picked-up image of the camera.

Note that as illustrated in FIG. 4, a stepped part 328 may be provided on the substrate 320 and the speaker unit SP and the through-hole 321 may be formed in different surfaces. Through this process, vibrations of the speaker unit SP can be prevented from being directly propagated to the camera fitted to the through-hole 321.

"An Arrangement Example of the Second Light Emission Section"

Next, an arrangement example of the second light emission section 35 that is a delivery section of the control command will be described. In a remote control apparatus on the premise of being normally put on a table, an obstacle is present between the remote control apparatus and a control target instrument depending on a surrounding environment in many cases and a lot of limitations are present to an installation location. For example, when all directions are supposed to be covered, it is ideal that the remote control apparatus is put on the floor. However, since a problem from a livelihood aspect is posed, the remote control apparatus is obliged to be installed on a desk or the like. In this case, if there is a light receiving section on the floor surface side in place of the installation location, performance as the remote control apparatus may be impaired.

In the present example, the second light emission section 35 is installed in the electronic instrument 3, that is, on the ceiling side. This process permits an influence owing to an obstacle to be reduced. Even in this case, the following points need to be noted. Firstly, it is necessary to emit infrared light in all directions and it is necessary that the infrared light should not interfere with illumination. Secondly, it is necessary to emit the infrared light in the horizontal direction and in the floor surface direction. The reason is that as the control target instrument, even an instrument that is installed on the ceiling or on a wall face in the vicinity of the ceiling as in an air-conditioning equipment is used and even an instrument that is installed on the floor side as in a television apparatus is used. An arrangement example of the second light emission section 35 in view of the above points will be described.

Figure 8:
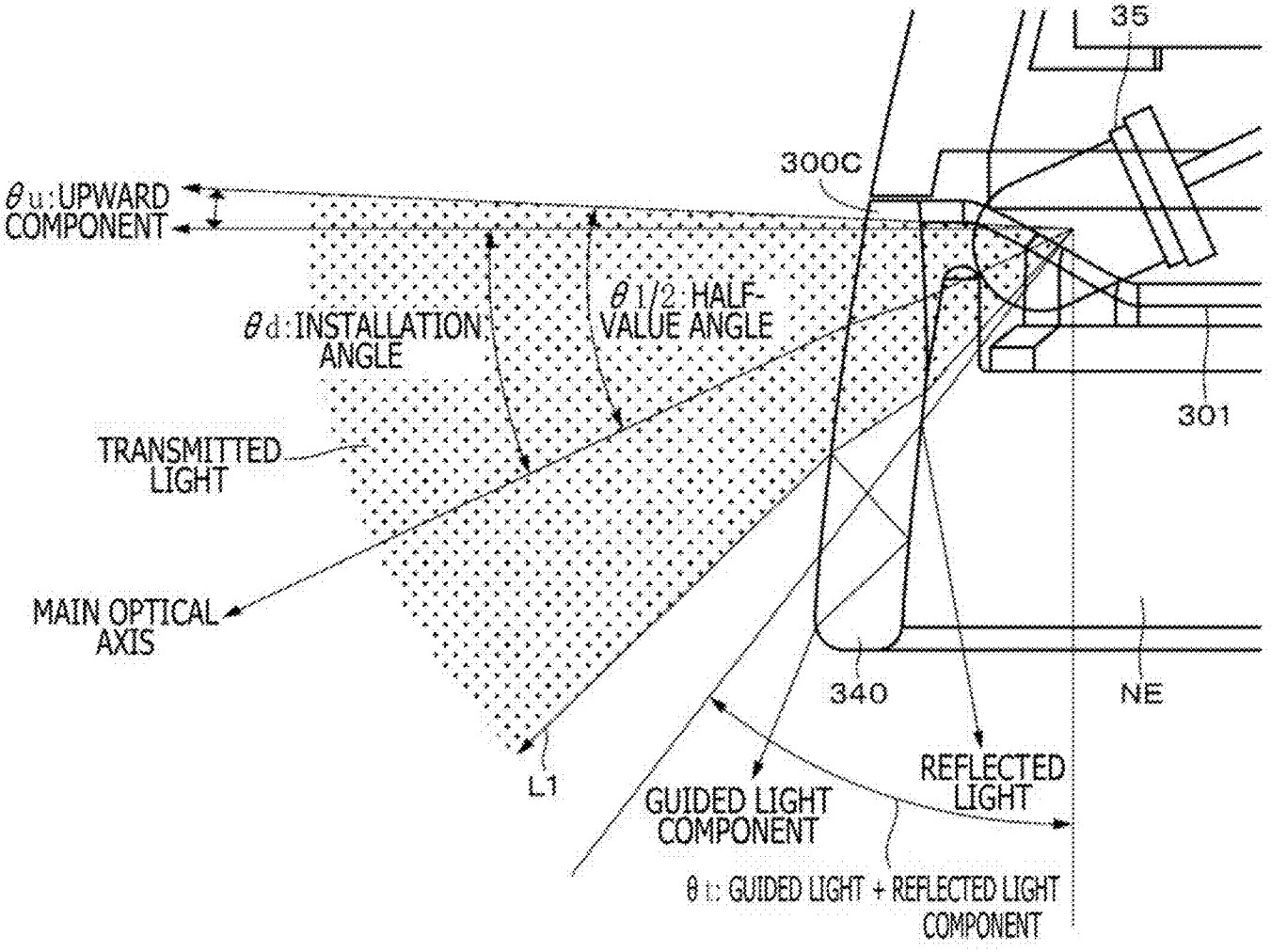
FIG. 8 is a diagram describing an arrangement example of a second light emission section according to the embodiment of the present technology.

FIG. 8 is a diagram that describes an arrangement example of the second light emission section 35 and that is illustrated by enlarging a predetermined portion of the electronic instrument 3. Note that when a transmission range of the second light emission section 35 that is an infrared LED is generally determined, an emission radiation intensity half-value angle (50% light emission intensity range) becomes a criterion of designing.

The second light emission section 35 is, for example, fitted to the flat part 301 by using an arbitrary fitting member. As described above, the outer edge of the lower housing part 300C functions as the light guide component 340. A portion of infrared light emitted from the second light emission section 35 is radiated via the light guide component 340.

An example of the light guide component 340 will be described. The light guide component 340 has, for example, a thickness of 1 to 2 mm and a cross section is formed in the form of plates. Materials having high transmittance of infrared light are used for quality of the materials of the light guide component 340 and, for example, polycarbonate (PC) or acrylic (PMMA) is used. Smoothness in an entrance plane is given to a surface state of the light guide component 340 to raise effectiveness of a reflection component. Further, by allowing materials having predetermined diffusivity to be included in the light guide component 340, leveling of radiation intensity characteristics along with discrete arrangements of the second light emission section 35 and an effect of enlarging an effective range owing to diffusion are realized. As an example, it is preferable to use a PC resin translucent diffusion material having a transmittance of 70% and diffusibility (diffusion angle from the emission surface of approximately 30 degrees) as optical characteristics.

Figure 9:
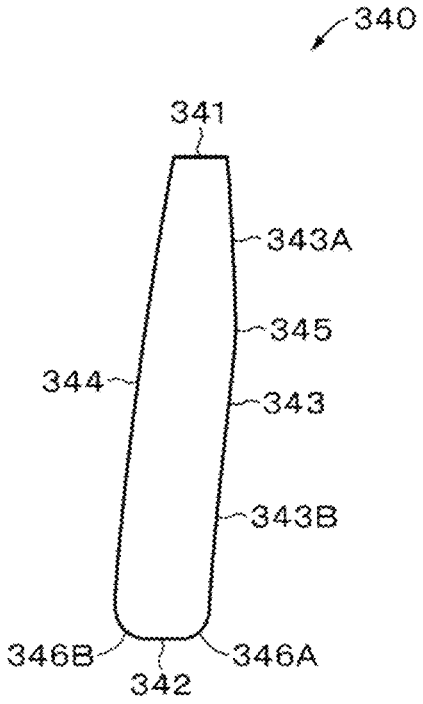
FIG. 9 is a diagram describing a light guide component according to the embodiment of the present technology.

FIG. 9 is a diagram cross-sectionally illustrating a portion that functions as the light guide component 340 in the lower housing part 300C. As illustrated in FIG. 9, the light guide component 340 has an upper face 341, a bottom face 342, and an inner face 343 and outer face 344 connecting the upper face 341 and the bottom face 342. The inner face 343 forms a constitution in which a first inner face 343A and a second inner face 343B are serially formed. The first inner face 343A is a face in which an optical beam of infrared light emitted from the second light emission section 35 is made incident in a critical angle or less. A border between the first inner face 343A and the second inner face 343B is a border part 345 and infrared light that is transmitted through this portion is a limit of a transmissive component.

The second inner face 343B and the outer face 344 are formed so as to be nearly parallel to each other. Through this process, a guided light component of infrared light to be described is obtained. Further, rounded R-shaped parts 346A and 346B are formed in at least one of a border between the bottom face 342 and the inner face 343 and a border between the bottom face 342 and the outer face 344.

Returning again to FIG. 8, descriptions will be made. The second light emission section 35 is arranged at a nearly equal angle on a horizontal radiation axis using as a central axis (Z axis) a direction vertical to (height) the floor surface. In the case of using, for example, infrared LEDs of a half-value angle θ½: ±27 degrees (full size: 52 degrees) as the second light emission section 35, when eight pieces of infrared LEDs are minimally arranged in a circular shape (in a radial pattern) as the number of the infrared LEDs, all directions (360 degrees) in the horizontal direction can be covered in theory. Note that in an overlapping portion in a transmission range of adjacent infrared light, characteristics obtained by superimposing both radiation intensities are used. In the present example, in addition to the above-described arrangement conditions, a predetermined angle is assigned to a main optical axis of the second light emission section 35 even in an axis horizontal to the floor surface. Specifically, considering an angle obtained by subtracting an angle component necessary for a ceiling direction (upward direction) from the half-value angle of the light emission radiation intensity of the second light emission section 35, the main optical axis is arranged tilting a predetermined angle downward. An angle decision in an upward component toward an axis horizontal to the floor surface, in another respect, an axis in a radial direction of a virtual circle in the case in which eight pieces of the second light emission sections 35 are connected by lines is appropriately decided so as to avoid light interference with the illumination apparatus 2 (e.g., a shade or a cover).

For example in the case in which the second light emission radiation intensity half-value angle θ½: infrared LED of ±27 degrees is used as the second light emission section 35 to be an upward component θu: +2 degrees, the main optical axis of the second light emission section 35 is subjected to an arrangement in which the main optical axis is rotated by an installation angle θd: −25 degrees (downward) toward an axis horizontal to the floor surface. Through this process, an effective range of the light emission radiation intensity half-value angle caused by infrared light transmitted through the first inner face 343A can cover even an effective component: −52 degrees (=−25-27 degrees) downwardly and even θu: +2 degrees upwardly. This process permits infrared light to be transmitted even to air-conditioning equipment etc. installed near to the ceiling.

On the other hand, even a downward transmission range of infrared light needs to be considered. Here, when the infrared LEDs are simply installed downwardly (the floor side), even a range in the vertical direction can be covered; however, the number of the infrared LEDs is increased and an increase in costs is caused. To solve the above problems, in the present example, the light guide component 340 is configured so that infrared light is transmitted to an emission direction, in other words, the second light emission section 35 is arranged inside the light guide component 340 and the infrared light is transmitted even in a nearly vertical direction without increasing the infrared LED.

Infrared light transmitted through the border part 345 of the light guide component 340 is a limit of transmitted light (transmissive component). In FIG. 8, the limit is indicated by an optical axis L1. A portion of infrared light made incident from the border part 345 downward is internally reflected in the light guide component 340 to be emitted. At this time, parallel faces (the second inner face 343B and the outer face 344) are formed in the light guide component 340, and thereby the infrared light that is internally reflected in the light guide component 340 can be diffused and emitted. In addition, the R-shaped parts 346A and 346B are formed, and thereby the infrared light that is internally reflected in the light guide component 340 can be more diffused and emitted. The infrared light that is internally reflected in the light guide component 340 is emitted as the guided light component.

Further, in the infrared light, a component (component made incident in the critical angle or more) that is totally reflected on a surface of the light guide component 340 is guided downward as a reflected light component. On the basis of the guided light component and the reflected light component, infrared light can be emitted to an angle range from −52 degrees leaked from a cover range of the transmitted component up to a lower vertical location (−90 degrees). That is, infrared light can be transmitted to even electric instruments (a television apparatus or a stationary audio apparatus) positioned on the floor side and the electric instruments can be controlled.

Figure 10A:
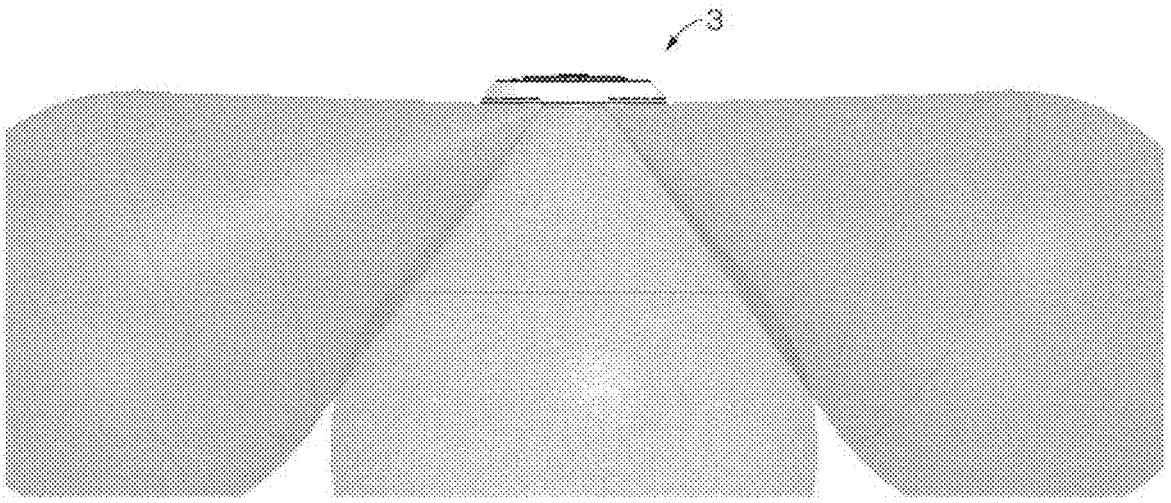
FIGS. 10A and 10B are diagrams schematically illustrating a transmission range of infrared light emitted from the second light emission section.
Figure 10B:
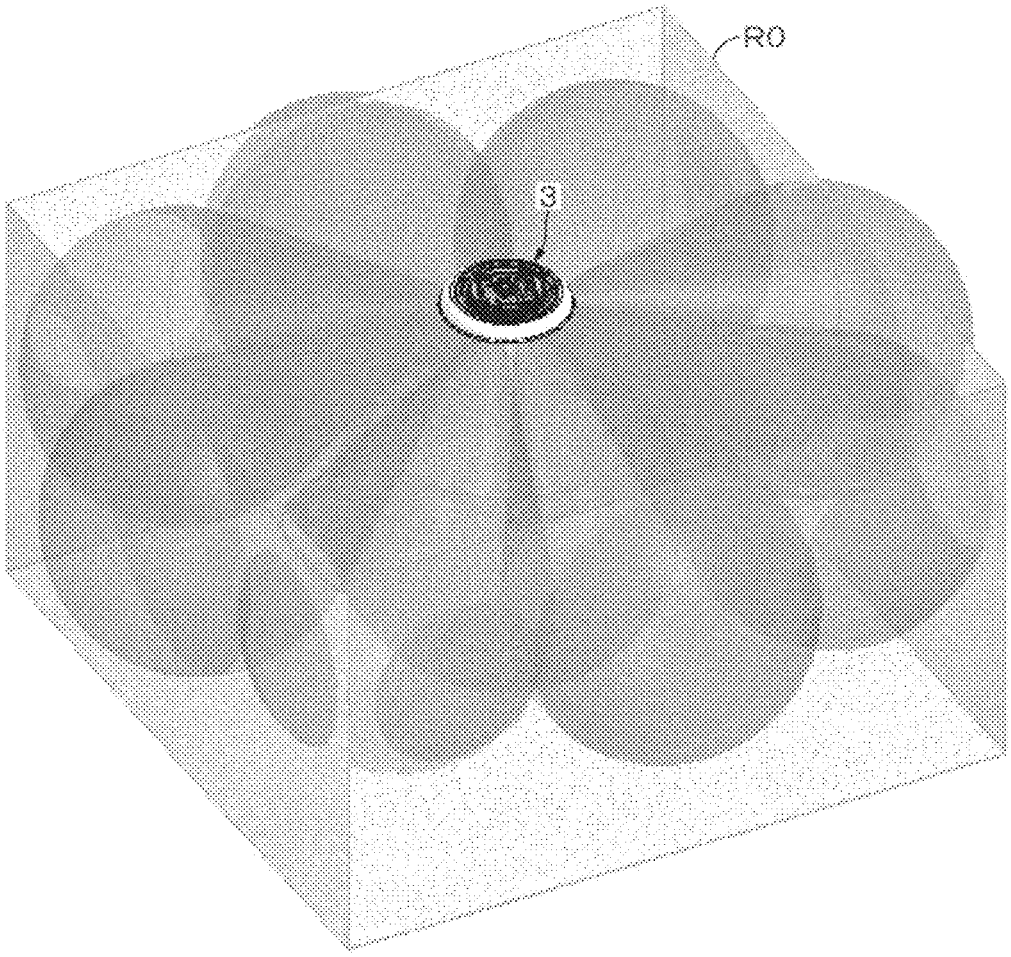

FIG. 10A is a diagram schematically illustrating a range capable of transmitting the infrared light emitted from the second light emission section 35. FIG. 10B is a diagram schematically illustrating a range capable of transmitting the infrared light emitted from the second light emission section 35 in doors RO. FIGS. 10A and 10B illustrate that the above-described range can be covered.

Figure 11:
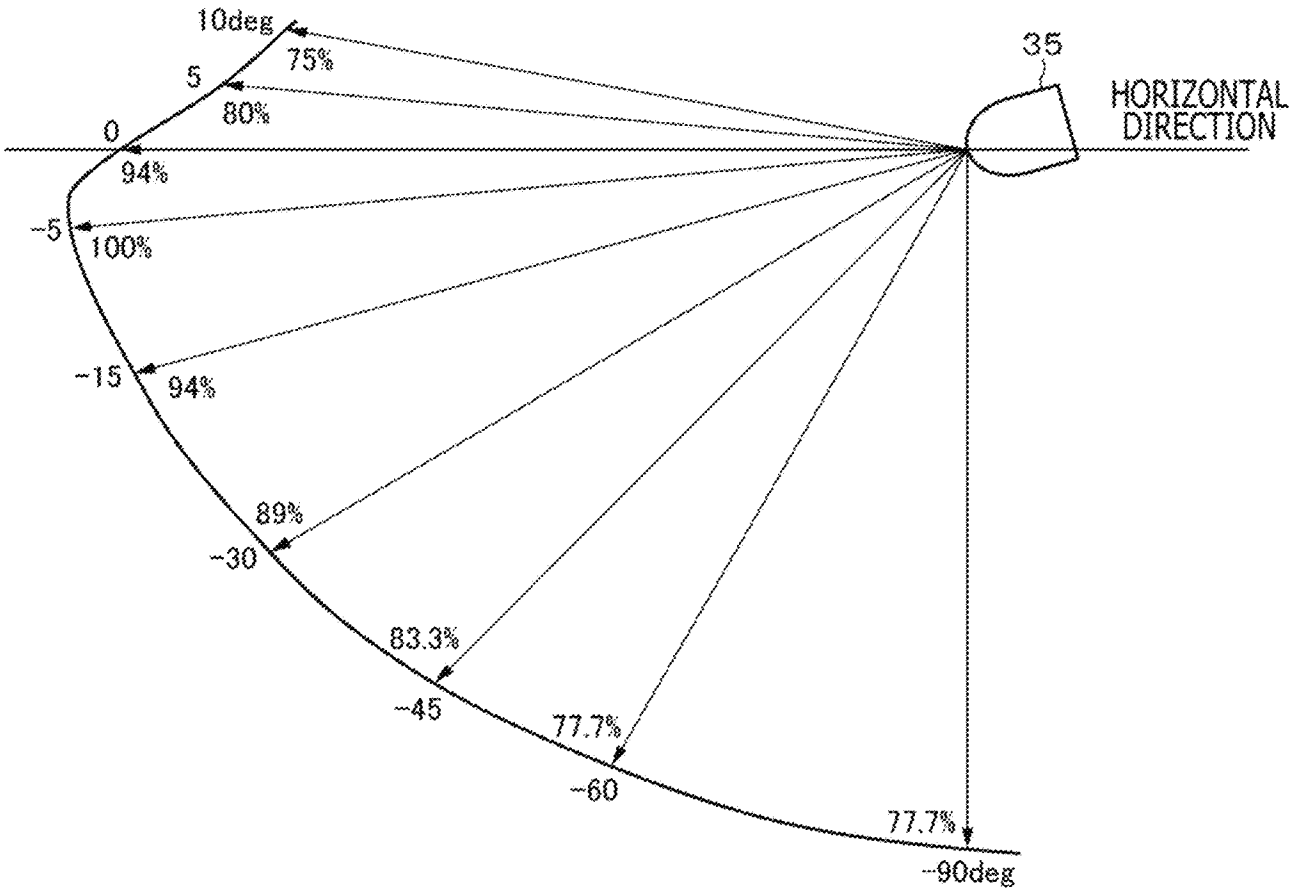
FIG. 11 is a diagram indicating by the degree an example of the transmission range of the infrared light emitted from the second light emission section.

FIG. 11 is a diagram in which a distance to which the infrared light emitted from a piece of the second light emission section 35 gets is relatively illustrated. Here, a longest distance (a location of −5 degrees corresponds) is supposed to be 100% and distances of other degrees are relatively illustrated. As illustrated in FIG. 11, the infrared light gets up to a distance of at least 75% or more of the longest distance and it is evident that there is no problem from a practical standpoint.

Note that there is the possibility that the reflected light component is intercepted by the speaker net NE in the configuration of the electronic instrument 3 in the present example. To solve the above problem, a gap may be formed as an example of a passage part that allows the reflected light component to pass through between the light guide component 340 and the speaker net NE. In addition, a hole part etc. that allow the reflected light component to pass through the speaker net NE may be formed. This process permits the infrared light to be more effectively emitted to the lower side.

Further, in the present example, an example in which a portion of the lower housing part 300C functions as the light guide component 340 is described. Further, a configuration in which the light guide component 340 is separated from the lower housing part 300C may be adopted. In addition, a configuration in which the light guide component 340 is locally formed in a direction of emitting the infrared light of the second light emission section 35 may be adopted.

2. Modified Example

Although the plurality of embodiments of the present technology are specifically described, the contents of the present technology are not limited to the above-described embodiments, and various modifications based on the technical idea of the present technology are possible. Hereinafter, modified examples will be described.

Figure 12A:
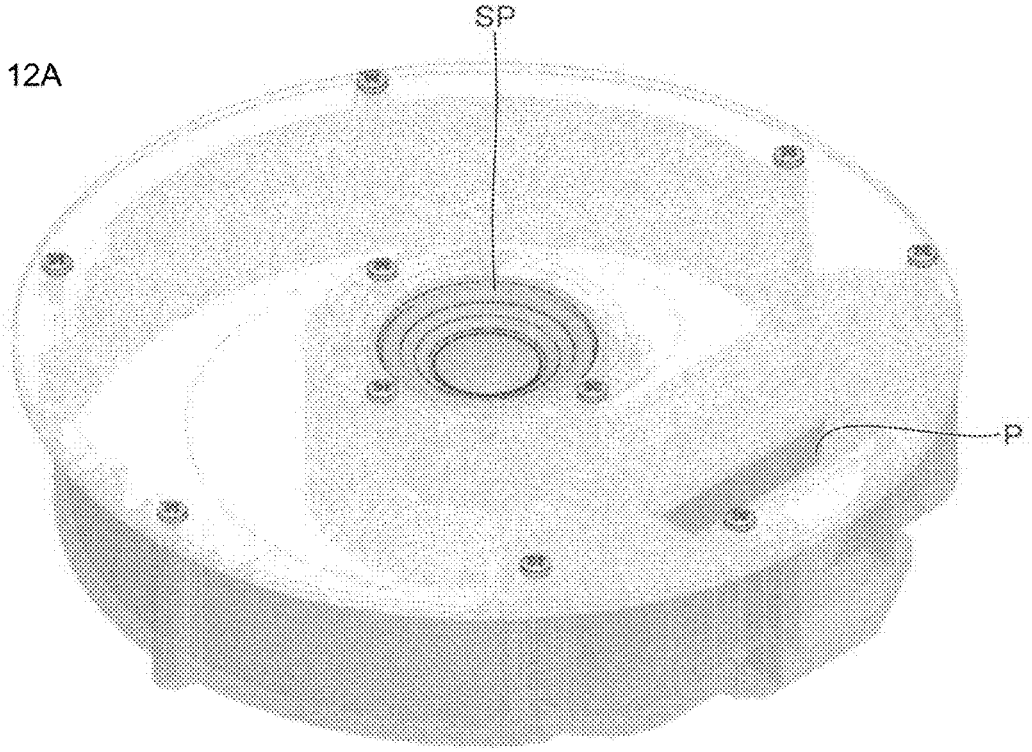
FIGS. 12A and 12B are diagrams describing a modified example.
Figure 12B:
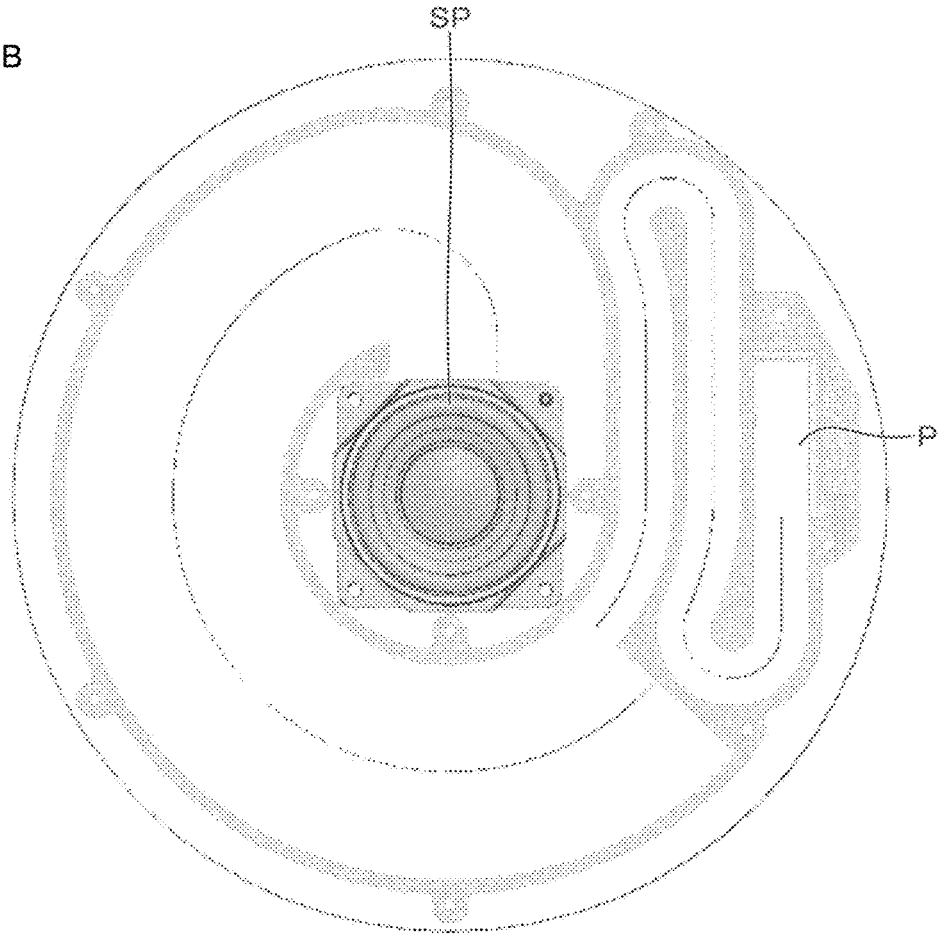
Figure 13A:
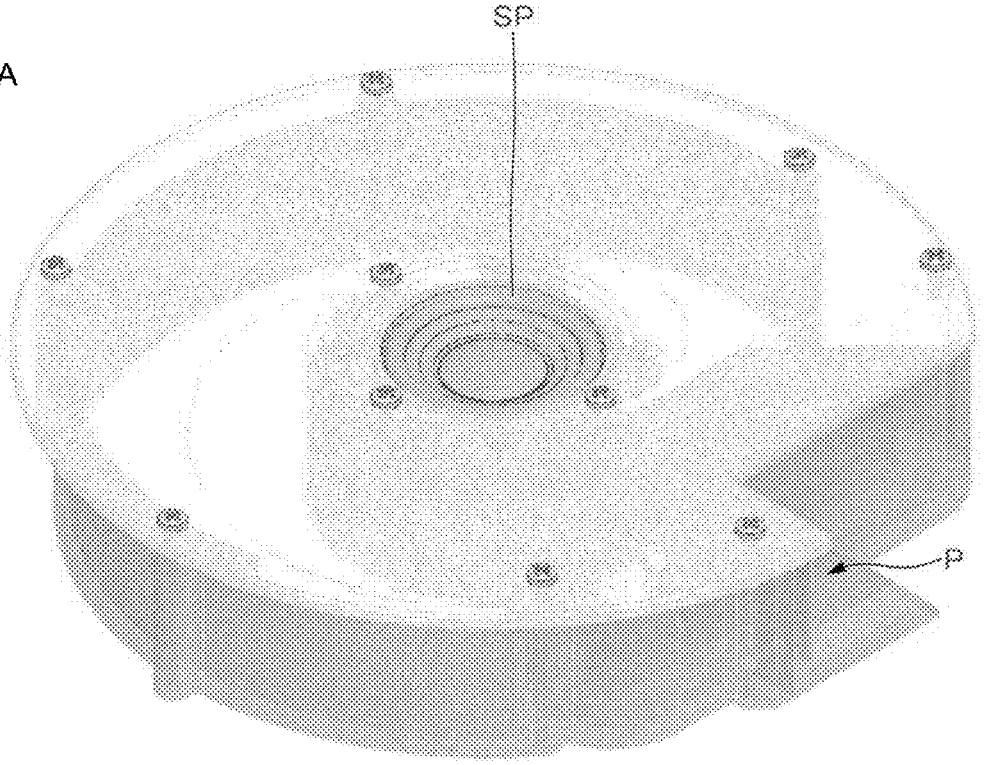
FIGS. 13A and 13B are diagrams describing a modified example.
Figure 13B:
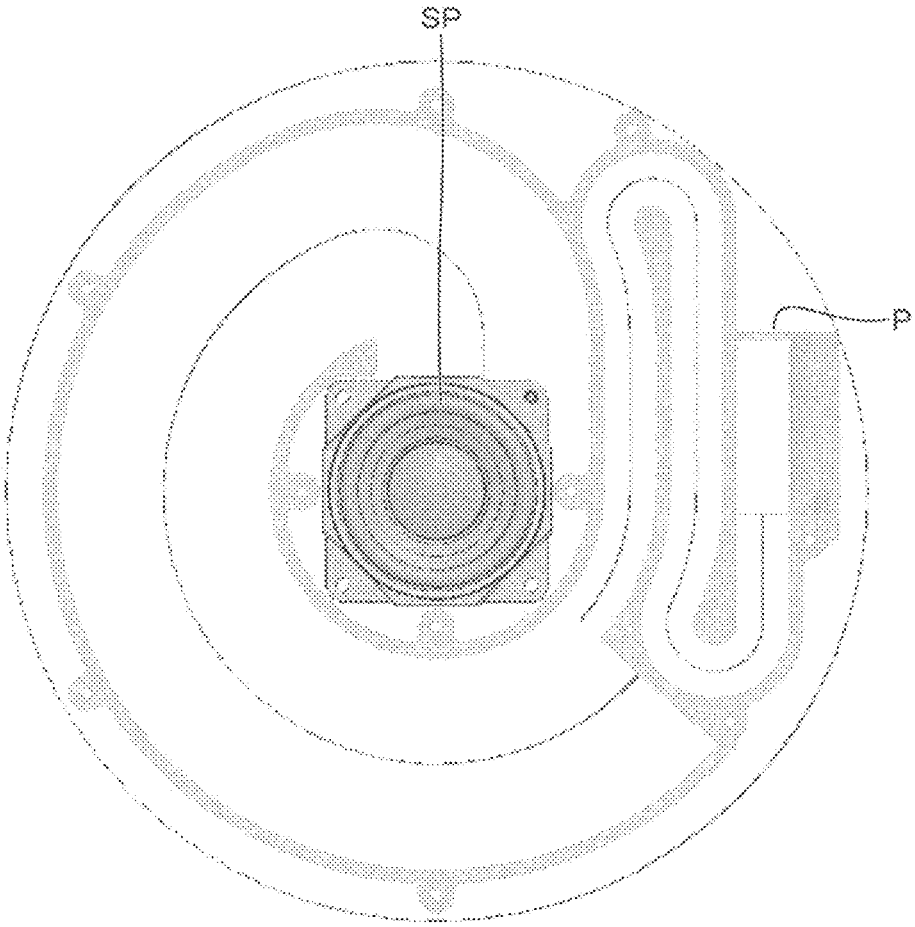
Figure 14A:
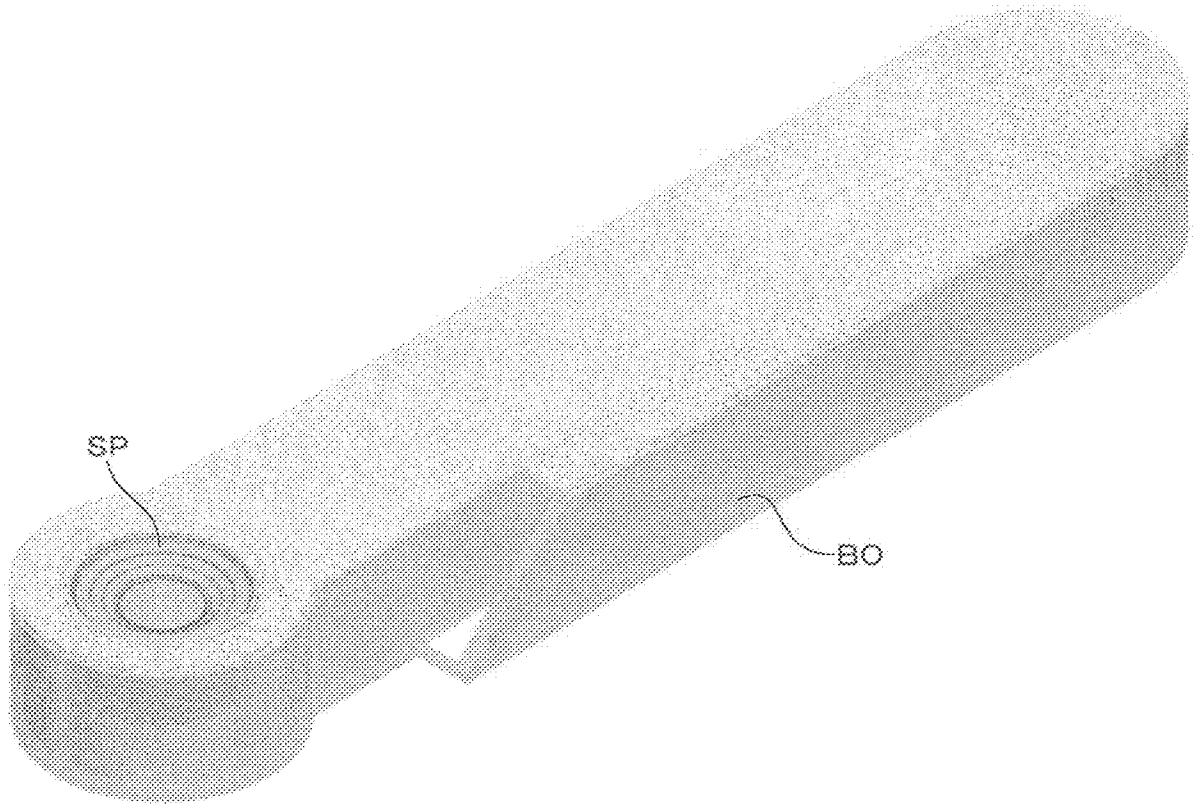
FIGS. 14A and 14B are diagrams describing a modified example.
Figure 14B:
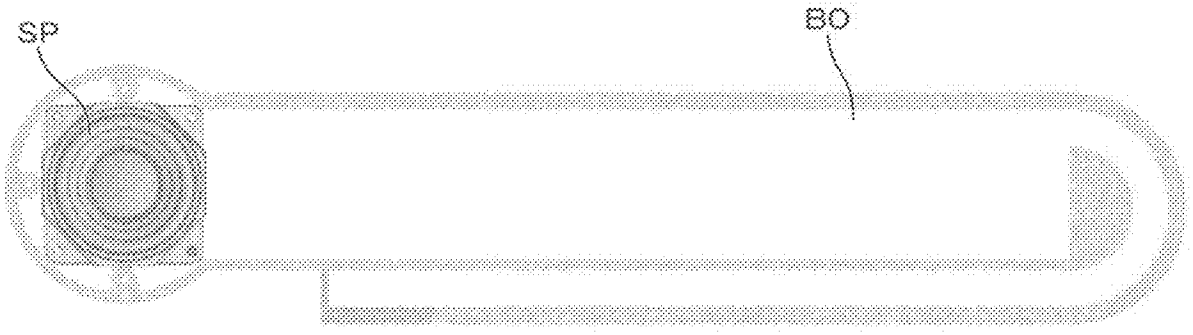

As illustrated in FIGS. 12A, 12B, 13A, and 13B, a shape of the speaker may be a shape of a convoluted speaker using a resonance tube. In this case, as illustrated in FIG. 12A, a port P may be formed in the same plane as that of the speaker unit SP, or as illustrated in FIG. 13A, the port P may be formed in a plane (nearly orthogonal plane) different from that of the speaker unit SP. Further, as illustrated in FIGS. 14A and 14B, a nearly U-shape may be formed as a shape of a speaker box BO. Further, a configuration using a passive radiator for a low-pass enhancement may be adopted.

Considering maintainability or the like, the first light emission section 22 can be configured so as to be attachable/detachable to/from the illumination apparatus 2 or may be an annular fluorescent lamp or the like. Further, the first light emission section 22 may be configured by LEDs for three primary colors (RGB) and the first light emission section 22 may be enabled to illuminate even the ceiling side. In addition, in accordance with music to be reproduced, the first light emission section 22 may illuminate the ceiling side by using different colors or emission modes.

The functions included in the electronic instrument 3 can be arbitrarily added and changed. For example, the electronic instrument 3 need not have the imaging function or may have other functions such as a projector. Note that as in the above-described embodiment, in the case of having the imaging function, an indicator that notifies the user that imaging is being performed may be formed.

A cross-sectional shape of the speaker box 330 is not limited to the above-described shapes of the embodiment and further may be an elliptical shape or the like.

In the above-described embodiment, an example in which the second light emission section 35 is fitted to the electronic instrument 3 is described, and further the second light emission section 35 may be fitted to the illumination apparatus 2.

A configuration in which the electronic instrument 3 is fitted to an apparatus (e.g., a fire-alarm box or an air-conditioning equipment) different from the illumination apparatus 2 may be adopted.

For example, in the present technology, the configurations, methods, processes, shapes, materials, numerical values, and the like included in the above-described embodiments are merely examples, and if necessary, different configurations, methods, processes, shapes, materials, numerical values, and the like may be used. In addition, the present technology can be realized by a device, a method, a system including a plurality of devices, and the like, and the matters described in the plurality of embodiments and the modified examples can be combined with each other as long as no technical inconsistency occurs.

Moreover, the present technology can adopt the following configurations.

(1)

An electronic instrument including:

a housing;

a fitting part that is freely attached/detached to/from an illumination apparatus; and a sound reproduction space that is formed in the housing.

(2)

The electronic instrument according to (1), in which the sound reproduction space has a shape having no faces parallel to each other.

(3)

The electronic instrument according to (1) or (2), in which the sound reproduction space has a cross-sectional shape of a deformed circular body.

(4)

The electronic instrument according to any one of (1) to (3), in which a speaker unit and a bass reflex duct are housed in the sound reproduction space, and at least one port shape of the bass reflex duct is set to a flare shape.

(5)

The electronic instrument according to any one of (1) to (4), further including:

a substrate in which the sound reproduction space is formed, in which an image pickup apparatus fitting part is formed in a position separated from the sound reproduction space in the substrate.

(6)

An illumination system including:

an illumination apparatus; and an electronic instrument that is freely attached/detached to/from the illumination apparatus, in which the electronic instrument includes a housing, a fitting part that is freely attached/detached to/from the illumination apparatus, and a sound reproduction space that is formed in the housing.

REFERENCE SIGNS LIST

2 . . . Illumination apparatus
3 . . . Electronic instrument
35 . . . Second light emission section
300 . . . Housing
330 . . . Speaker box
331 . . . Bass reflex port
332 . . . Bass reflex duct
340 . . . Light guide component
SP . . . Speaker unit
T5, T6, T8 . . . Terminal

The invention claimed is:

1. An electronic instrument, comprising:

a first housing;

a fitting part detachably connected to an illumination apparatus; and a second housing inside the first housing, wherein the second housing is a sound reproduction space, the second housing houses a speaker unit, the sound reproduction space has a deformed circular shape, the deformed circular shape has a deformity in which a portion of a circle is deformed towards inside, and the deformed circular shape has a first protrusion separated from a second protrusion by the deformation.

2. The electronic instrument according to claim 1, wherein the deformed circular shape has no faces parallel to each other.

3. The electronic instrument according to claim 1, wherein the second housing further houses a bass reflex duct, the bass reflex duct comprises at least one port, and a shape of the at least one port is a flare shape.

4. The electronic instrument according to claim 3, wherein the speaker unit is on a face of the sound reproduction space, and a position of the face is lower than a light emission surface of the illumination apparatus.

5. The electronic instrument according to claim 1, further comprising a substrate, wherein the sound reproduction space is on a first region of the substrate, an image pickup apparatus fitting part is on a second region of the substrate, and the first region is different from the second region.

6. An illumination system, comprising:

an illumination apparatus; and an electronic instrument, wherein the electronic instrument includes:

a first housing;

a fitting part detachably connected to the illumination apparatus; and a second housing inside the first housing, wherein the second housing is a sound reproduction space, the second housing houses a speaker unit, the sound reproduction space has a deformed circular shape, the deformed circular shape has a deformity in which a portion of a circle is deformed towards inside, and the deformed circular shape has a first protrusion separated from a second protrusion by the deformation.

* * * * *